US005090688A

United States Patent [19]

Sasaki

[11] Patent Number: 5,090,688

[45] Date of Patent: Feb. 25, 1992

[54] SHEET SORTER HAVING MOVABLE BIN TRAYS

[75] Inventor: Nobukazu Sasaki, Tokyo, Japan

[73] Assignee: Canon Kabushiki Kaisha, Tokyo, Japan

[21] Appl. No.: 590,597

[22] Filed: Sep. 27, 1990

Related U.S. Application Data

[63] Continuation of Ser. No. 816,964, Jan. 8, 1986, abandoned, which is a continuation of Ser. No. 484,700, Apr. 13, 1983, abandoned.

[30] Foreign Application Priority Data

Apr. 21, 1982 [JP] Japan ..... 57-66863
May 8, 1982 [JP] Japan ..... 57-76915

[51] Int. Cl.[5] ..... B65H 39/10
[52] U.S. Cl. ..... 271/293; 271/294
[58] Field of Search ..... 271/293, 294

[56] References Cited

U.S. PATENT DOCUMENTS 3,788,640 1/1974 Stemmle ..... 271/293
4,332,377 6/1982 DuBois et al. ..... 271/293
4,337,936 7/1982 Lawrence ..... 271/293
4,343,463 8/1982 Lawrence ..... 271/293
4,433,837 2/1984 Romanowski ..... 271/293
4,466,609 8/1984 Lawrence ..... 271/293
4,478,406 10/1984 DuBois ..... 271/293
4,512,565 4/1985 Matsumoto et al. ..... 271/293
4,854,571 8/1989 Kitajima et al. ..... 271/293
4,880,223 11/1989 Yamazaki et al. ..... 271/293

FOREIGN PATENT DOCUMENTS 2075957 11/1981 United Kingdom ..... 271/293

*Primary Examiner*—Matthew C. Graham
*Attorney, Agent, or Firm*—Fitzpatrick, Cella, Harper & Scinto

[57] ABSTRACT

This invention provides a compact and efficient sheet sorting apparatus having plural bin trays arranged in mutually superposed manner, support structure for supporting the rear ends of the plural bin trays in movable manner, a spiral cam members for controlling the movement of the front ends of the bin trays with the aid of followers provided on the bin trays and engaging apparatus for facilitating the engagement between the followers of the bin trays and the spiral cam members.

10 Claims, 10 Drawing Sheets

SHEET SORTER HAVING MOVABLE BIN TRAYS

This application is a continuation of application Ser. No. 816,964 filed Jan. 8, 1986, now abandoned, which is a continuation of parent application Ser. No. 484,700 filed Apr. 13, 1983, now abandoned.

BACKGROUND OF THE INVENTION

1. Field of the Invention

The present invention relates to a sheet sorter for distributing document sheets, supplied from an image forming apparatus such as a copier, a duplicator or a facsimile, in successive manner into receiving trays or bins.

2. Description of the Prior Art

It has been desired to reduce the dimension and weight of the sheet sorter for distributing and classifying the original documents and copying sheets (hereinafter collectively referred to as "sheet") continuously ejected from a copier. Dimensional reduction is however difficult in a sheet sorter with a number of bin trays since such trays require a large volume. Such dimensional reduction is rendered possible by maintaining the gaps between the mutually parallel trays wider only at the sheet receiving position but narrower in other positions, thereby saving the entire volume. However, in a sheet sorter in which the sheets are driven at a high speed, it has been difficult to effect the gap widening motion of the trays in secure manner with low noise and with low power consumption, corresponding to the high-speed transportation of the sheets.

SUMMARY OF THE INVENTION

In consideration of the foregoing, a first object of the present invention is to provide a sheet sorter which is of low weight and compact in dimension and which is capable of moving the bin trays with a low power consumption.

A second object of the present invention is to provide a sheet sorter light in weight, compact in dimension and capable of high-speed elevating and lowering motion of the bin trays in secure manner.

A third object of the present invention is to provide a sheet sorter with a large number of bin trays, which is light in weight, compact in dimension and is capable of high-speed elevating and lowering motion of the bin trays in secured manner.

The foregoing objects can be achieved according to one aspect of the present invention by a sheet sorter comprising a plurality of bin trays arranged in mutually parallel manner, means for supporting the rear ends of said plural bin trays in mutually movable manner, and spiral cam means engaging with follower members provided on said bin trays, wherein said follower members engage with an engaging member of said spiral cam means at each rotation thereof to displace the front ends of said bin trays thereby controlling the gaps therebetween.

In another aspect of this invention said sheet sorter comprises a plurality of bin trays arranged in mutually parallel manner, means for supporting the rear ends of said plural bin trays in mutually movable manner, spiral cam means engaging with follower members provided on said bin trays, and supporting frame means which engages with said bin trays to define a limit gap between bin trays and is rendered movable along said spiral cam means, said follower members engaging with an engaging member of said spiral cam means at each rotation thereof to displace the front ends of said bin trays thereby controlling the gaps therebetween, and the follower members having moved to an end of said spiral cam means receive the weight of other bin trays.

In still another aspect of this invention, said sheet sorter comprises a plurality of bin trays arranged in mutually parallel manner, means for supporting the rear ends of said plural bin trays in mutually movable manner, spiral cam means engaging with follower members provided on said bin trays, and supporting frame means which engages with said bin trays to define a limit gap between bin trays and is rendered movable along said spiral cam means, said follower members engaging with an engaging member of said spiral cam means at each rotation thereof to displace the front ends of said bin trays thereby controlling the gaps therebetween, and said supporting means moving with the displacement of said supporting frame means.

In still another aspect of this invention, said sheet sorter comprises a plurality of bin trays arranged in mutually parallel manner, means for supporting the rear ends of said plural bin trays in mutually movable manner, spiral cam means engaging with follower members provided on said bin trays to displace said bin trays, and biasing means for causing mutual attraction between an upper bin tray and a lower bin tray, the follower member of a bin tray engaging by biasing action with the engaging member of the spiral cam means to control the gap between an engaged bin tray and other bin trays before said engaging.

In the present invention, as shown in the above aspects, a low power consumption is achievable since the follower member of each bin tray engages with the engaging member of said spiral cam at each rotation thereof to displace the bin tray. Also high-speed displacement of bin trays is rendered possible by high-speed motion of said spiral cam even with light-weight bin trays, since the weight of all the bin trays is applied onto the follower members at the engagement of the follower member of each bin tray with the groove-shaped engaging member of said spiral cam. Furthermore, the present invention allows provisions of a sheet sorter which is light in weight, small in dimension and is provided with a plurality of bin trays movable at a high speed.

DESCRIPTION OF THE PREFERRED EMBODIMENTS

Now an explanation will be given on a first embodiment of the present invention shown in the attached drawing.

Figure 1:
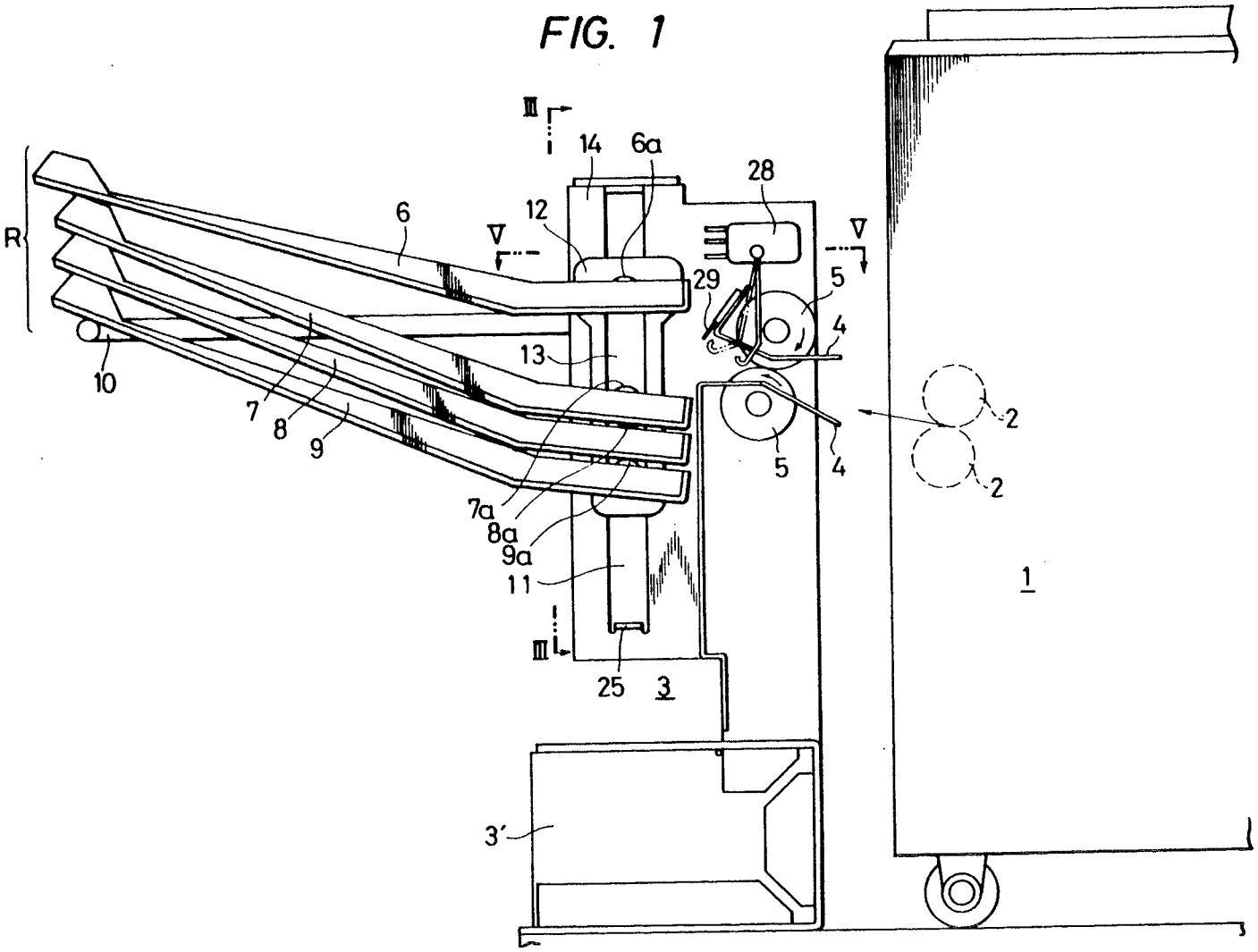
FIG. 1 is a lateral cross-sectional view of a sheet sorter representing a first embodiment of the present invention.

FIG. 1 is a lateral cross-sectional view of a sheet sorter showing an embodiment of the present invention, wherein the sheets ejected in successive manner from paired ejecting rollers 2 of a copier 1 are transported through guides 4 of a sheet sorter 3 positioned facing to said paired ejecting rollers 2 and are stored by paired transport rollers 5 into bin trays 6–9. Said paired transport rollers 5 are rotated, by a not-shown motor, when said bin trays are stopped. Rear or outer ends R of mutually overlapping plural bin trays 6–9 are supported by a supporting arm 10 of the sheet sorter 3 and are rendered mutually slidable.

Figure 3:
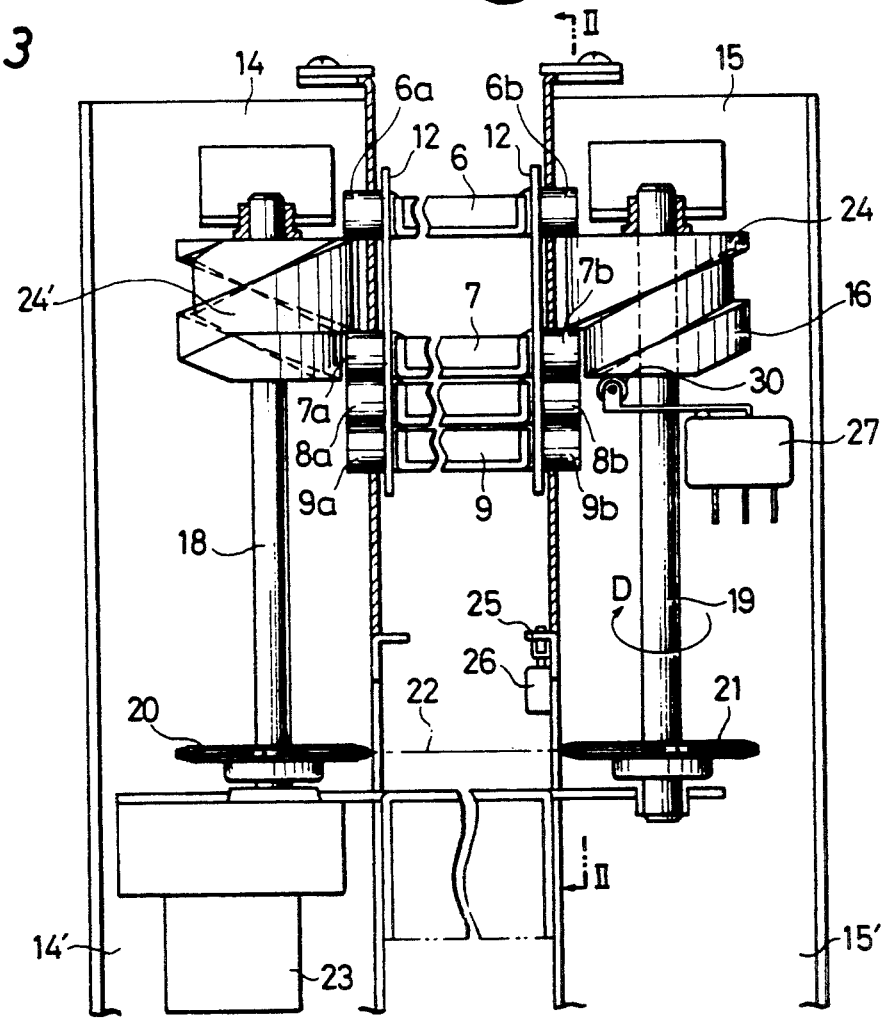
FIG. 3 is a cross-sectional view along a line III—III shown in FIG. 1.

As shown in FIG. 3, on both sides of the sheet receiving side of the sheet sorter 3 there are provided supporting pillars 14, 15, each of which is provided on the lateral face thereof with a vertically extending slot 11. Further as shown in FIG. 3, in said slots 11 slidably engage cylindrical followers, e.g. trunnions, 6*a*, 6*b*, 7*a*, 7*b*, 8*a*, 8*b*, 9*a*, 9*b* provided at the front or inner ends of lateral edges of said bin trays. Said followers further engage with a supporting frame 12.

Figure 2:
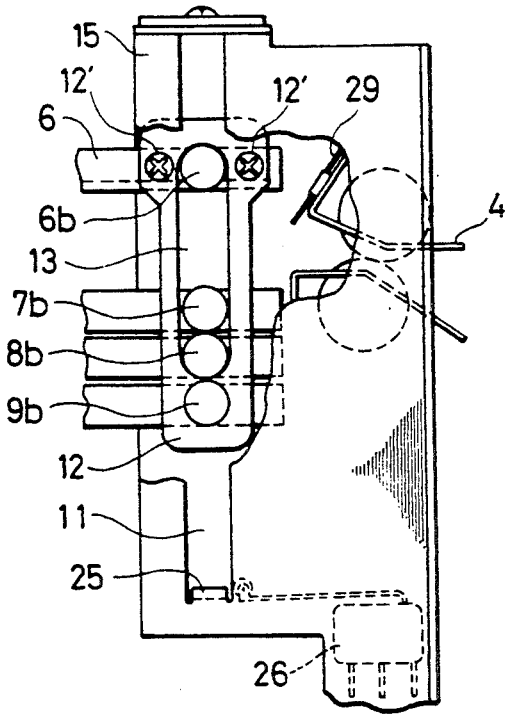
FIG. 2 is a cross-sectional view along a line II—II in FIG. 3, showing the engagement between a supporting frame 12 and each follower member.

FIG. 2 is a side view showing the engagement between said followers and said supporting frame 12, which is provided with an elongated hole 13 in the similar manner as said slot 11 for enabling vertical sliding motion along the slot 11. At the upper part of the supporting frame 12 are fitted the followers 6*a*, 6*b* of the uppermost bin tray 6, of which lateral faces are fixed to said supporting frame 12 by means of screws 12'. Consequently, in this embodiment, the bin tray 6 does not rotate with respect to the supporting frame 12 but the bin tray vertically moves together with said supporting frame. The followers 7*a*, 7*b*, 8*a*, 8*b* and 9*a*, 9*b* of other bin trays 7, 8, 9 are vertically slidably fitted in the elongated holes 13 of the supporting frame 12.

The aforementioned supporting arm 10 is vertically movable together with the supporting frame 12 while supporting the rear ends of the bin trays, since said arm 10 is fixed to said supporting frame 12 at the side of the transport rollers 5.

In case the supporting arm 10 is to be fixed to the pillars 14, 15, the followers 6*a*, 6*b*, of the uppermost bin tray 6 are not fixed to the supporting frame 12 but are rotatably fitted therein, thereby enabling vertical displacement of the front ends alone of the bin trays, while limiting the movement of the rear ends of said bin trays. Such structure allows spontaneous sheet aligning at the front ends of the bin trays during the vertical movement of the front end thereof, and is adapted for use in a sheet sorter with bin trays of a relatively limited number.

In this embodiment, the supporting arm 10 performs vertical movement together with the supporting frame 12 as already explained in the foregoing, and such structure becomes more advantageous as the number of the bin trays increases, since, in the structure with the fixed supporting arm 10, the uppermost bin tray becomes more steeply inclined with the increase in number of the bin trays, leading to the undesirable slippage or creasing of the sheets. Also the rotatable structure of the bin trays allows easy access to the sheet on the bin trays by rotating said bin trays clockwise in FIG. 1.

FIG. 3 is a cross-sectional view along a line III—III in FIG. 1, seen from the rear ends of the bin trays. The pillars 14, 15 at right and left are provided with a pair of spirally grooved cams 24 each of which is provided with a one-turn spiral groove 24' of a determined pitch and which are respectively fitted at the upper part of vertical rotary shafts 18, 19. Said rotary shafts 18, 19 are provided at the lower part thereof with sprockets 20, 21 for transmitting, through a chain 22, the rotary force of a motor 23 provided in the sheet sorter to the spiral cams 24. Said motor 23 can be rotated in either direction, and a rotation of the rotary shaft 19 in a direction D for elevating the bin trays will hereinafter be referred to as normal or forward rotation.

Figure 4:
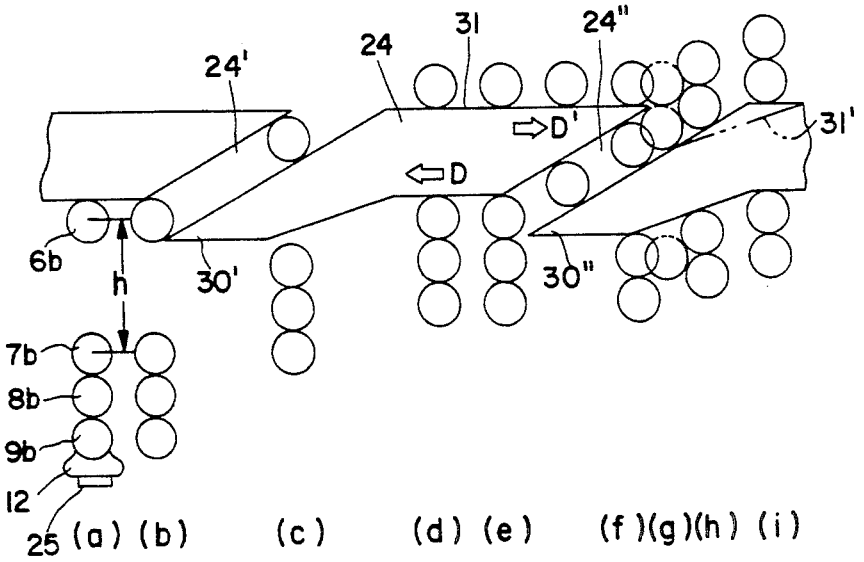
FIG. 4 is a developed view of the outer periphery of the spiral cam.

FIG. 4 is a developed view of the external periphery of the spiral cams 24, wherein a range from a spiral groove 24' to another spiral groove 24" corresponds to one turn (b) to (e) in the forward direction of the spiral cam 24.

Figure 5:
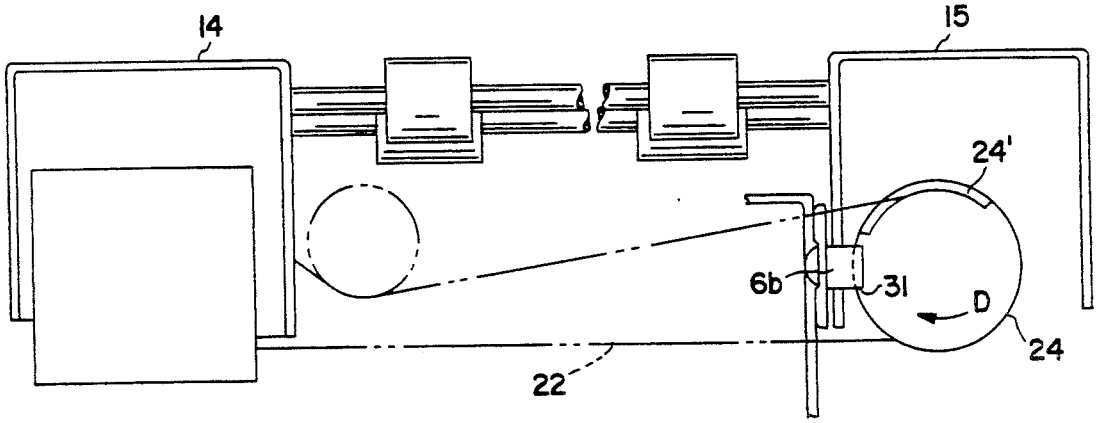
FIG. 5 is a cross-sectional view along a line V—V in FIG. 1.

Now there will be explained the sheet sorting operation while making reference to FIGS. 1 to 4. When the sheet sorter in stopped state is activated by a signal from the copier 1 or by an instruction externally entered by the operator, the motor 23 starts reverse rotation to lower the supporting frame 12, together with the front ends of the bin trays, along the slots 11. In FIG. 4, a state (d) indicates the positions of the followers of the bin trays in FIG. 1. FIG. 5 is a horizontal cross-sectional view of said pillars 14, 15, wherein the follower 6*b* is placed on an upper flat face of the spiral cam 24. This state corresponding to the state (d) shown in FIG. 4 and corresponds to the normal stopping position of the spiral cams 24.

The descent of the supporting frames 12 is initiated by the reverse rotation D' of the spiral cams 24. Through the supporting frames 12, the followers 6*a*, 6*b* receive all the weight of the bin trays 6, 7, 8, 9. Thus, when the spiral groove 24' arrives under the follower 6*b* by the reverse rotation of the spiral cams 24, the follower 6*b* enters the spiral groove 24' even if it is not steep is less steep than the remaining portion of the groove or it has certain resistance, and descends by the guidance of said groove 24'. The support-frame 12 descends to the lower end 25 of the slots together with the bin trays, while maintaining a bin gap h determined by the elongated holes 13 of the supporting frames 12. Said reverse rotation D' is terminated when a microswitch 26 provided at the lowermost end of the slot 11 is actuated by the lower end of the supporting frame 12 and a microswitch 27 detects that the spiral cams 24 have reached the normal stopping positions represented by (a) in FIG. 4. The actuation of said microswitch starts from a position (b).

Upon termination of the reverse rotation D', the uppermost bin tray 6 is in a position to receive the transported sheets. Simultaneously with the completion of said reverse rotation, the transport rollers 5 start to rotate and advance the sheet, supplied from the paired ejecting rollers 2, into said bin tray 6. The passage of the sheet is detected by a microswitch 28 provided downstream of the paired transport rollers 5. The static charge on said sheet is eliminated by contact with a charge eliminating brush 29.

When said microswitch 28 identifies the absence of sheet at the paired transport rollers 5 by sensing the sheet, said rollers 5 stop rotation and the motor 23 starts forward rotation. The starting positions of the bin trays in this case are represented by (a) in FIG. 4. By the forward rotation D, an acute-angled follower pickup part 30' constituting the lower end of the spiral groove 24' of the spiral cam 24 contacts the lower periphery of the follower **6*b* to bring the follower 6*b* into engagement with the groove 24', thereby elevating said follower 6*b* along, together with the supporting frame 12, along the groove 24'. Other bin trays 7, 8, 9 are not guided by the spiral grooves 24' of the spiral cams 24 but are lifted in the same manner as the supporting frame 12, and, when the follower 6*b* reaches the normal stopping position (d) on the upper flat face 31 of the spiral cam, a microswitch 27 is actuated to terminate the forward rotation D. Simultaneously the paired transport rollers 5 which have been stopped are activated to advance a sheet into the bin tray 7. When the microswitch 28 detects the completion of said sheet advancing, the paired transport rollers 5 are stopped again and the spiral cams 24 initiate forward rotation D to lift the bin tray 8** to the sheet-receiving position through the steps (e), (f), (g), (h) and (i).

After the rotation of the spiral cams 24 by a number of turns equal to the number of bin trays minus one, the follower **9*b* of the lowermost bin tray 9 approaches the lower face of the spiral cams 24, and the follower 8*b* of the second bin tray 8 from the bottom reaches the position of the followers 6*b*, 7*b* of the bin trays 6, 7 already supported on the upper flat face 31 of the spiral cam. When the counting of number of actuations of the microswitch 27 confirms that the lowermost bin tray 9 reaches the sheet-receiving position, the paired transport rollers 5 are rotated to advance a sheet into the bin tray 9**.

In case the number of sheets continuously ejected from the copier is larger than the number of bin trays, all the surplus sheets can be stored in the lowermost bin tray, which can be formed deeper than other bin trays for this purpose. Also the pillars 14, 15 may be rendered vertically movable at the base portions 14', 15' thereof to adjust the vertical position of the supporting frames 12, so that the sheet sorter can be adapted to various copiers regardless of the sheet ejecting position thereof.

In the present embodiment, for example in a cycle from a state (d) to (i) shown in FIG. 4, the spiral groove 24'' does not bear the weight of all the bin trays supported by the supporting frames 12 but only needs to guide the follower **7*b* of a single bin tray 7 until said follower 7*b* comes into contact with the follower 6*b* of the uppermost bin tray 6 in a state (g). The driving force required for the spiral cams 24 is small since plural followers need not be guided in said spiral groove 24''. Besides said spiral groove 24'' receives the weight of all the bin trays supported by the supporting frames 12 only when a follower present in the spiral groove 24'' is pushed upwards in contact with other followers present on the upper flat face. It is therefore possible to reduce the rotary load of the spiral cams and to avoid fluctuation in the load if the slope of said groove is made less steep, as represented by a chain line 31' in FIG. 4**, after said contact state. Also in order to further reduce said rotary load, the followers may be composed of rotatable rollers. The followers formed as cylinders, rotatable rollers or spheres facilitate the insertion of the pickup part of the spiral cam between the followers, thereby ensuring the lifting operation of the bin trays.

When the sheets are inserted into all the bin trays, the motor 23 performs reverse rotation to cause reverse rotation D' of the spiral cams 24. The followers **8*a*, 8*b* of the bin tray 8 receive, while gliding on the upper flat faces 31, the weight of the bin trays 6, 7, 9 through the supporting frames 12, so that said followers 8*a*, 8*b* are securely introduced into the spiral grooves. The structure of the present embodiment is particularly suitable for introducing the followers of the uppermost bin tray 6 into the spiral grooves. Although each bin tray has been made smaller and lighter for the purpose of reducing the dimension and the weight of the sheet sorter, the present embodiment permits secure introduction of the followers 6*a*, 6*b* into the spiral grooves as even the uppermost bin tray 6** receives the weight of other bin trays through the supporting frames. It is therefore rendered possible to avoid the lack of descent of the bin trays caused by the jumping thereof over the spiral grooves even when the rotation of the spiral cams is made faster for achieving high-speed ascent or descent of the bin trays.

Figure 6:
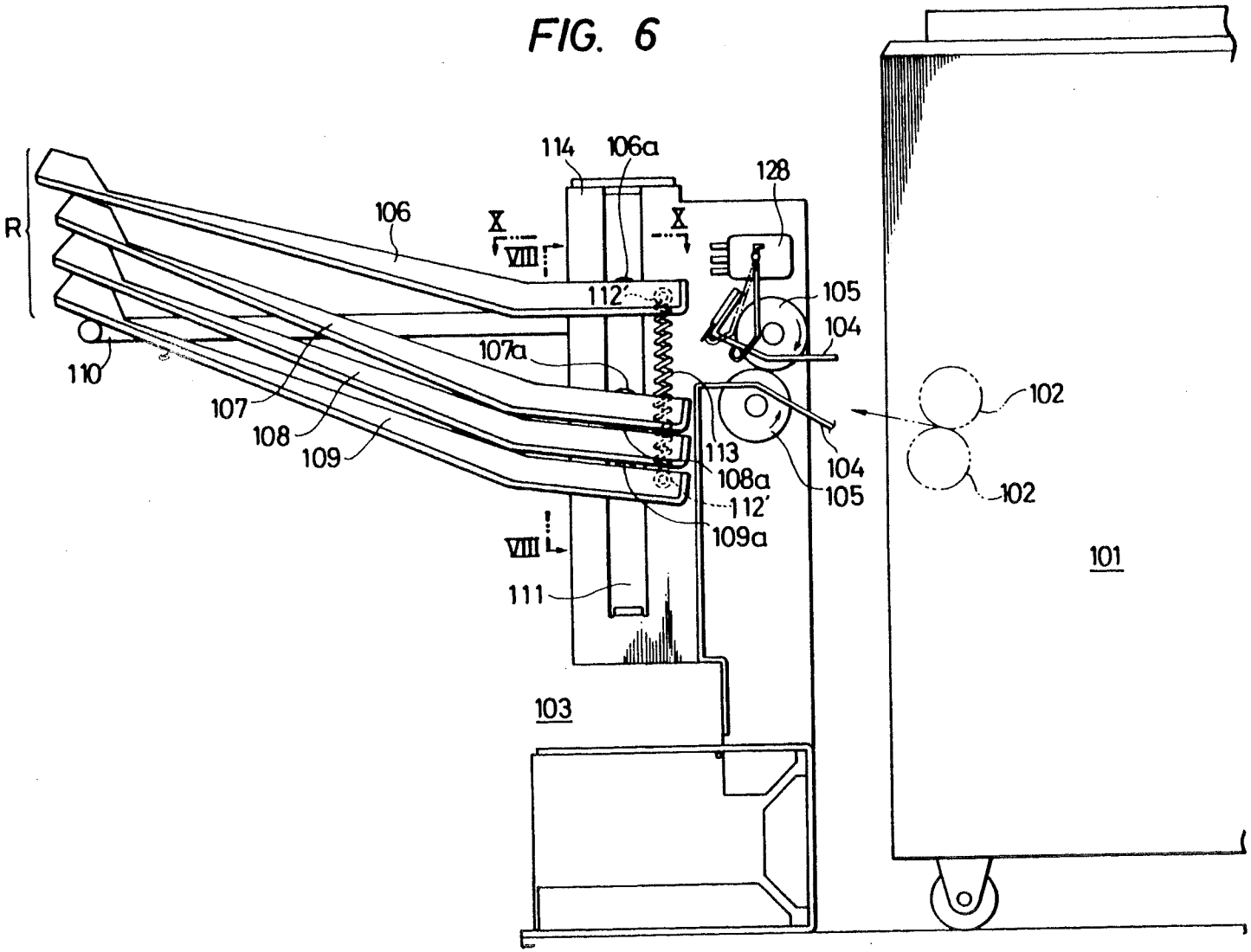
FIG. 6 is a lateral cross-sectional view of a sheet sorter representing a second embodiment of the present invention.

Now there will be explained another embodiment of the present invention. FIG. 6 is a lateral cross-sectional view of a sheet sorter representing another embodiment of the present invention, wherein the sheets continuously ejected by paired ejecting rollers 102 of a copier 101 are advanced through guides 104 of a sheet sorter 103 positioned facing said paired ejecting roller 102 and stored by paired transport rollers 105 into bin trays 106–109. Said paired transport rollers 105 are activated by a not-shown motor when said bin trays are in stopped state. Rear ends R of the mutually superposed plural bin trays 106–109 are supported by a supporting arm 110 which is fixed to the sheet sorter 103 or is rendered vertically displaceable with respect thereto, whereby the rear ends of said bin trays 106–109 are rendered mutually slidable.

Figure 8:
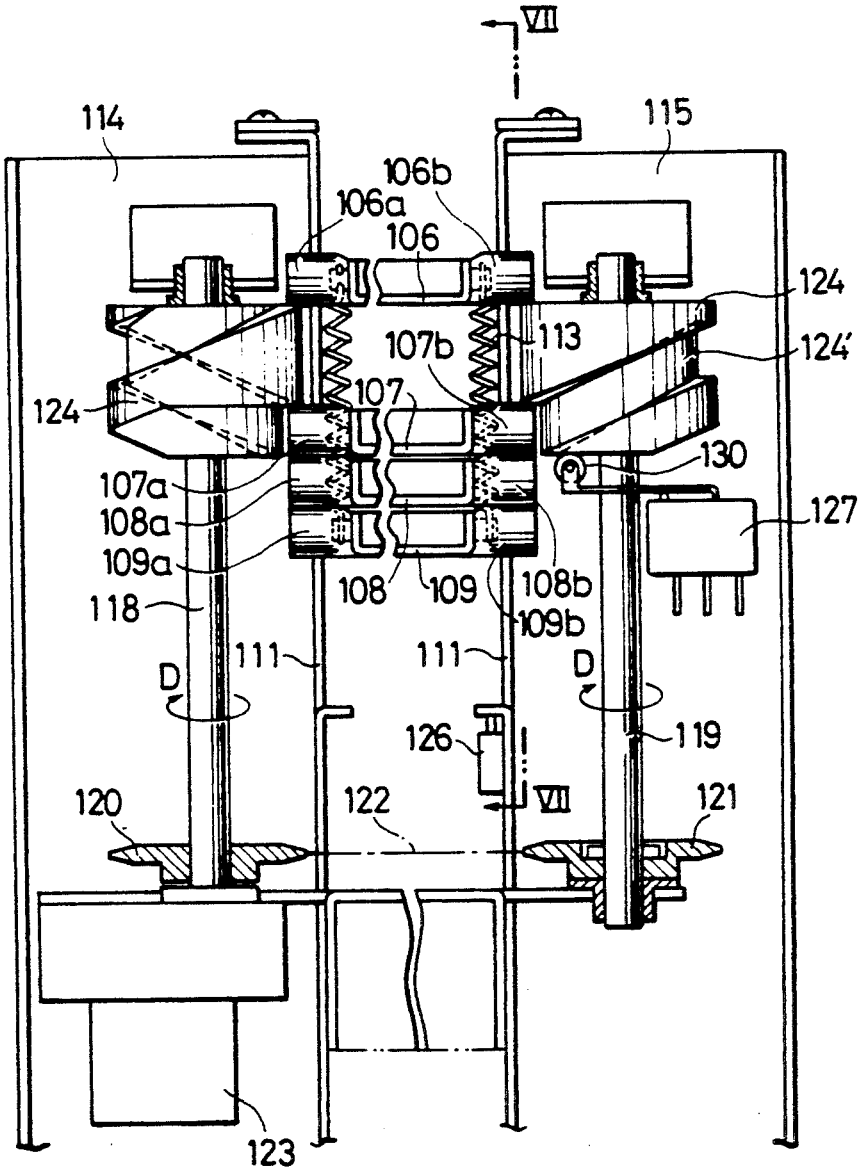
FIG. 8 is a cross-sectional view along a line VIII—VIII shown in FIG. 6.

On both sides of the sheet-receiving side of the sheet sorter there are provided pillars 114, 115 as shown in FIG. 8, each of which is provided on the lateral face thereof with a vertically extending slot 111. In said slots 111 slidably engage cylindrical followers **106*a*, 106*b*, 107*a*, 107*b*, 108*a*, 108*b*, 109*a*, 109*b* provided at the front end of lateral edges of said bin trays, as shown in FIG. 8. Also the uppermost and lowermost bin trays are provided, on lateral sides thereof, with a pair of pins 112', and springs 113** provided between said pins exert biasing force to mutually pull said bin trays each other.

Figure 7:
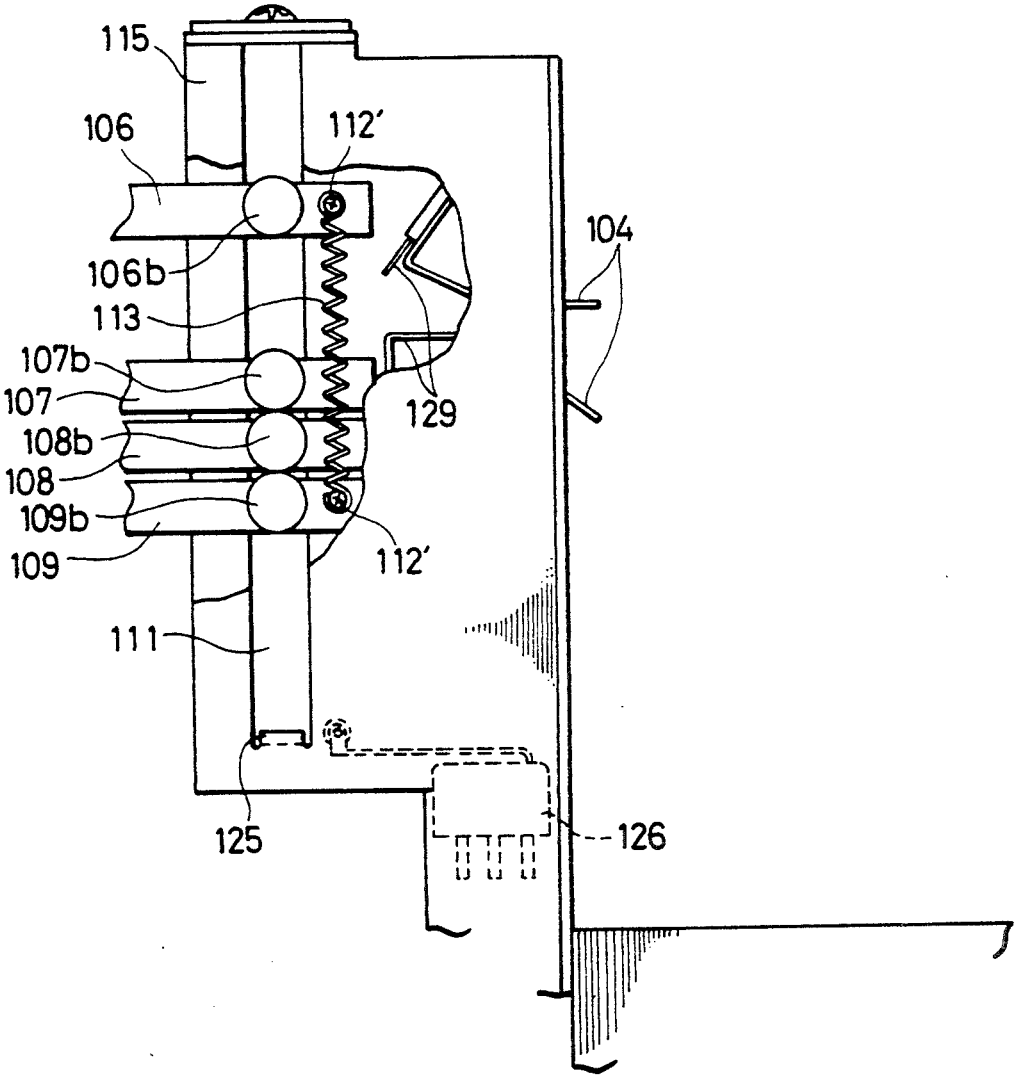
FIG. 7 is a cross-sectional view along a line VII—VII shown in FIG. 8 and representing the engagement between the supporting frame 12 and each follower member.

FIG. 7 is a cross-sectional view showing the engagement between the followers and the slots 111 at the front end part of said bin trays. Therefore the front ends of the bin trays are vertically movable along the slots 111 while leaving freedom to rotate about the followers.

The supporting arm 110 may be fixed on the pillars 114, 115 in case the number of the bin trays is limited as in the present embodiment or in case the bin trays are relatively shallow, since the inclination of the bin trays does not become excessively large by the vertical movement of the bin trays. In case the number of the bin trays increases, said supporting arm 110 can be vertically movable along the pillars 114, 115 in order to avoid excessive inclination of said bin trays and to ensure stable stacking of sheets thereon. The vertical movement of the supporting arm 110 can be easily achieved, through a chain or a rack and a pinion, by the elevating means such as rotary shafts 118, 119 or a motor 123 for the bin trays.

Since the bin trays are separably supported at the rear ends thereof on the supporting arm, said bin trays can be rotated in the clockwise direction to facilitate the access to the sheets stored therein.

FIG. 8 is a cross-sectional view along a line VII—VII in FIG. 6 as seen from the rear ends of the trays, wherein the pillars 114, 115 at the left and right are respectively provided with spiral cams 124 each of which has a one-turn spiral groove 124' of a determined pitch. Said cams are fitted on the upper part of vertical rotary shafts 118, 119 which are provided at the base part thereof with sprockets 120, 121 for transmitting, through a chain 122, the rotary force of a motor 123 provided in the sheet sorter 103 to said spiral cam 124. Said motor 123 can be driven in either direction, and a rotation of the rotary shaft 119 in a direction D for elevating the bin trays will hereinafter be called normal or forward rotation.

Figure 9:
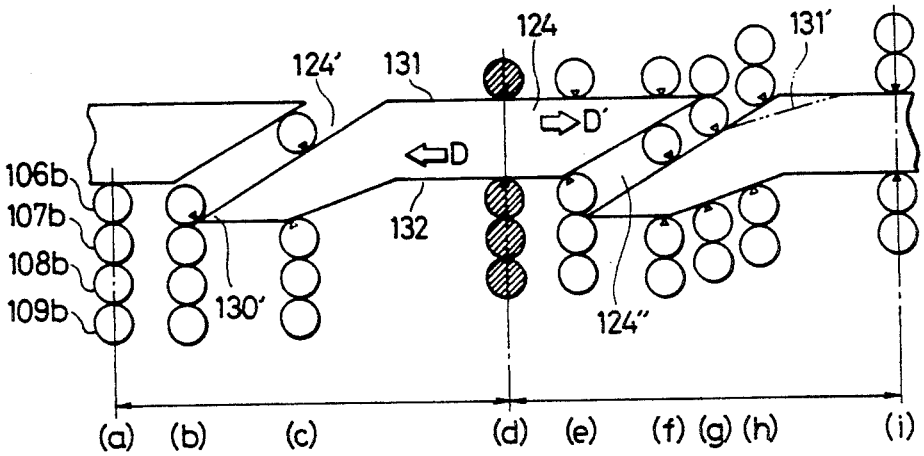
FIG. 9 is a developed view of the outer periphery of the spiral cam.

FIG. 9 is a developed view of the external periphery of the spiral cams 124, wherein a range from a groove 124' to another groove 124" corresponds to a full turn (b)–(e) of the normal rotation of the cam 124.

Figure 10:
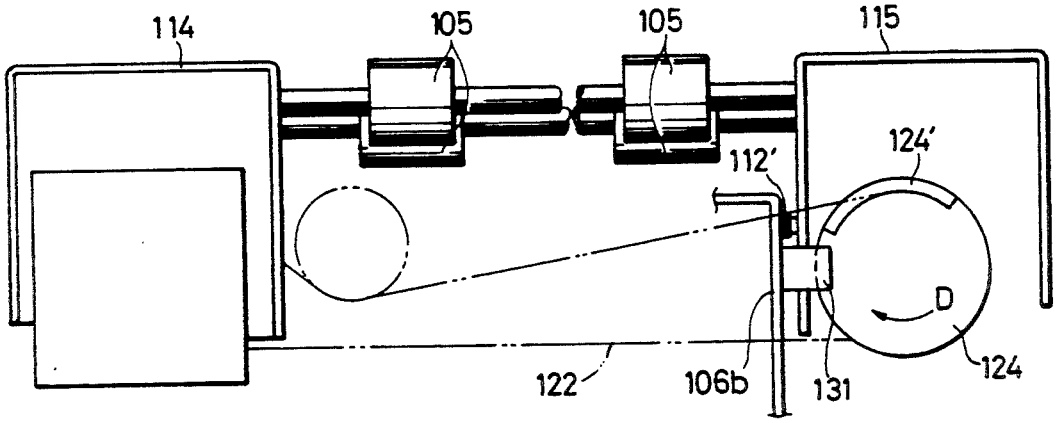
FIG. 10 is a cross-sectional view along a line X—X shown in FIG. 6.

Now there will be explained the sheet sorting operation with reference to FIGS. 6 to 9. When the sheet sorter in the stopped position is activated by a signal from the copier 101 or by an external instruction entered by the operator, the motor 123 starts reverse rotation whereby the front end of the bin tray 106 supported on the spiral cams 124 by the followers **106*a*, 106*b* descends along the slots 111. In FIG. 9, a state (d) indicates the positions of the followers of the bin trays in FIG. 6. FIG. 10 is a planar cross-sectional view of said pillars 114, 115, wherein the follower 106*b* is placed on the upper flat face of the spiral cam 124. This state corresponds to the state (d) in FIG. 9 and represents the normal stopping position of said spiral cam 124**.

The descent of the followers **106*a*, 106*b* is initiated by the reverse rotation D' of the spiral cams 124. Said followers 106*a*, 106*b* receive, through the springs 113, the weight of all the bin trays 106, 107, 108, 109. When the spiral groove 124' becomes positioned under the follower 106*b* by the reverse rotation of the spiral cam 124, said follower 106*b* enters said groove 124' even if said groove 124' is not inclined steeply or has certain sliding resistance, and descends along said groove 124'. All the bin trays are biased by the springs 113 to mutually attract, so that the bin trays for example 106, 107 mutually separated by the spiral cams 124 are biased against the upper flat faces 131 and the lower flat faces 132 thereof. Consequently the followers present on the upper flat faces of the cams securely enter the spiral grooves 124' even at high-speed reverse rotation D' of said cams 124. The preparation for receiving the sheet is completed when the uppermost bin tray 106 is rapidly lowered to the lower flat face 132. In this state the lowermost bin tray 109 touches a microswitch 126 positioned at the lower end of the slots 111, and the reverse rotation D' is terminated when a microswitch 127 detects that the spiral cams 124 are in the normal stopping position corresponding to a state (a) in FIG. 9**. In fact the actuation of said microswitch is started from a state (b).

Simultaneously with the termination of said reverse rotation, the paired transport rollers 105 start to rotate thereby introducing the sheet supplied from the paired ejecting rollers 102, into the bin tray 106. The passage of the sheet is detected by a microswitch 128 provided downstream the paired transport rollers 105, and the static charge on said sheet is eliminated by contact with a charge eliminating brush 129.

When said microswitch 128 detects the absence of a sheet at the paired transport rollers 105 by sensing the sheet, said rollers 105 stop rotation and the motor 123 starts forward rotation. The starting positions of the bin trays in this case are represented by (a) in FIG. 9. By said forward rotation D, an acute-angled pickup part 130' constituting the lower end of the spiral groove 124' of the spiral cam 124 contacts the lower periphery of the follower **106*b*, thereby elevating said follower 106*b* alone, together with the supporting frame 112, along the groove 124'. Other bin trays 107, 108, 109 are not guided by the spiral grooves 124' of the spiral cams 124 but are lifted by the springs 113, and, when the follower 106*b* alone reaches the normal stopping position (d) on the upper flat face 131 of the spiral cam, a microswitch 127 is actuated to terminate the forward rotation D. Simultaneously the paired transport rollers 5 which have been stopped are activated to advance a sheet into the bin tray 107. When the microswitch 128 detects the completion of said sheet advancing, the paired transport rollers 105 are stopped again and the spiral cams 124 initiate forward rotation D to lift the bin tray 108** to the sheet-receiving position through the steps (e), (f), (g), (h) and (i).

After the rotation of the spiral cams 124 by a number of turns equal to the number of bin trays minus one, the follower **109*b* of the lowermost bin tray 109 approaches the lower face of the spiral cams 124, and the follower 108*b* of the second bin tray 108 from the bottom reaches the position of the followers 106*b*, 107*b* of the bin trays 106, 107 already supported on the upper flat face 131 of the spiral cam. When the counting of number of actuations of the microswitch 127 confirms that the lowermost bin tray 109 reaches the sheet-receiving position, the paired transport rollers 105 are rotated to advance a sheet into the bin tray 109**.

In case the number of sheets continuously ejected from the copier is larger than the number of bin trays, all the surplus sheets can be stored in the lowermost bin tray, which can be formed deeper than other bin trays for this purpose. Also the pillars 114, 115 may be rendered vertically movable at the base portions 114', 115' thereof to adjust the vertical position of the supporting frames 112, so that sheet sorter can be adapted to various copiers regardless of the sheet ejecting position thereof.

In the present embodiment, for example in a cycle from a state (d) to (i) shown in FIG. 9, the spiral groove 124" does not bear the weight of all the bin trays even in the presence of the springs 113 but only needs to guide the follower **107*b* of a single bin tray 107 until said follower 107*b* comes into contact with the follower 106*b* of the uppermost bin tray 106 in a state (g). The driving force required for the spiral cams 124 is small since plural followers need not be guided in said spiral grooves 124". Besides said spiral groove 124" receives the weight of all the bin trays supported by the supporting frames 112 only when a follower present in the spiral groove 124" is pushed upwards in contact with other followers present on the upper flat face. It is therefore possible to reduce the rotary load of the spiral cams and to avoid fluctuation in the load if the slope of said groove is made less steep, as represented by a chain line 131' in FIG. 9**, after said contact state. Also in order to further reduce said rotary load, the followers may be composed of rotatable rollers. The followers formed as cylinders, rotatable rollers or sphered facilitate the insertion of the pickup part of the spiral cam between the followers, thereby ensuring the lifting operation of the bin trays.

When the sheets are inserted into all the bin trays, the motor 123 performs reverse rotation to cause reverse rotation D' of the spiral cams 124. The followers 108*a*, 108*b* of the bin tray 108 receive, while gliding on the upper flat faces 131, the weight of the bin trays 106, 107, 109 through the supporting frames 112, so that said followers 108*a*, 108*b* are securely introduced into the spiral grooves. The structure of the present embodiment is particularly suitable for introducing the followers of the uppermost bin tray 106 into the spiral grooves. Although each bin trays has been made smaller and lighter for the purpose of reducing the dimension and the weight of the sheet sorter, the present embodiment allows to securely introduce the followers 106*a*, 106*b* into the spiral grooves as even the uppermost bin tray 106 receives the biasing force of the springs 113 and the weight of other bin trays through said springs 113. It is therefore rendered possible to avoid the lack of descent of the bin trays caused by the jumping thereof over the spiral grooves even when the rotation of the spiral cams is made faster for achieving high-speed ascent or descent of the bin trays.

Figure 11A:
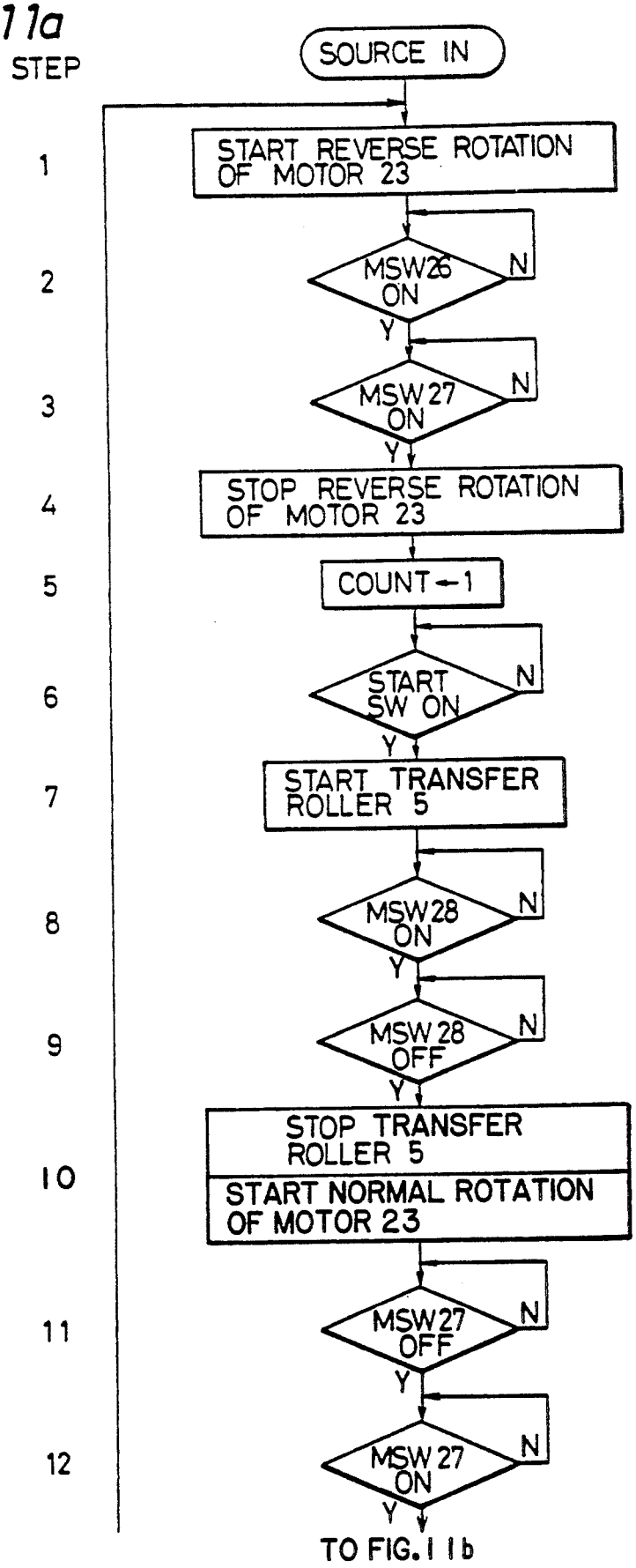
FIG. 11*a*, FIGS. 11*b* and 11*c* are a flow chart showing the control flow.
Figure 11B:
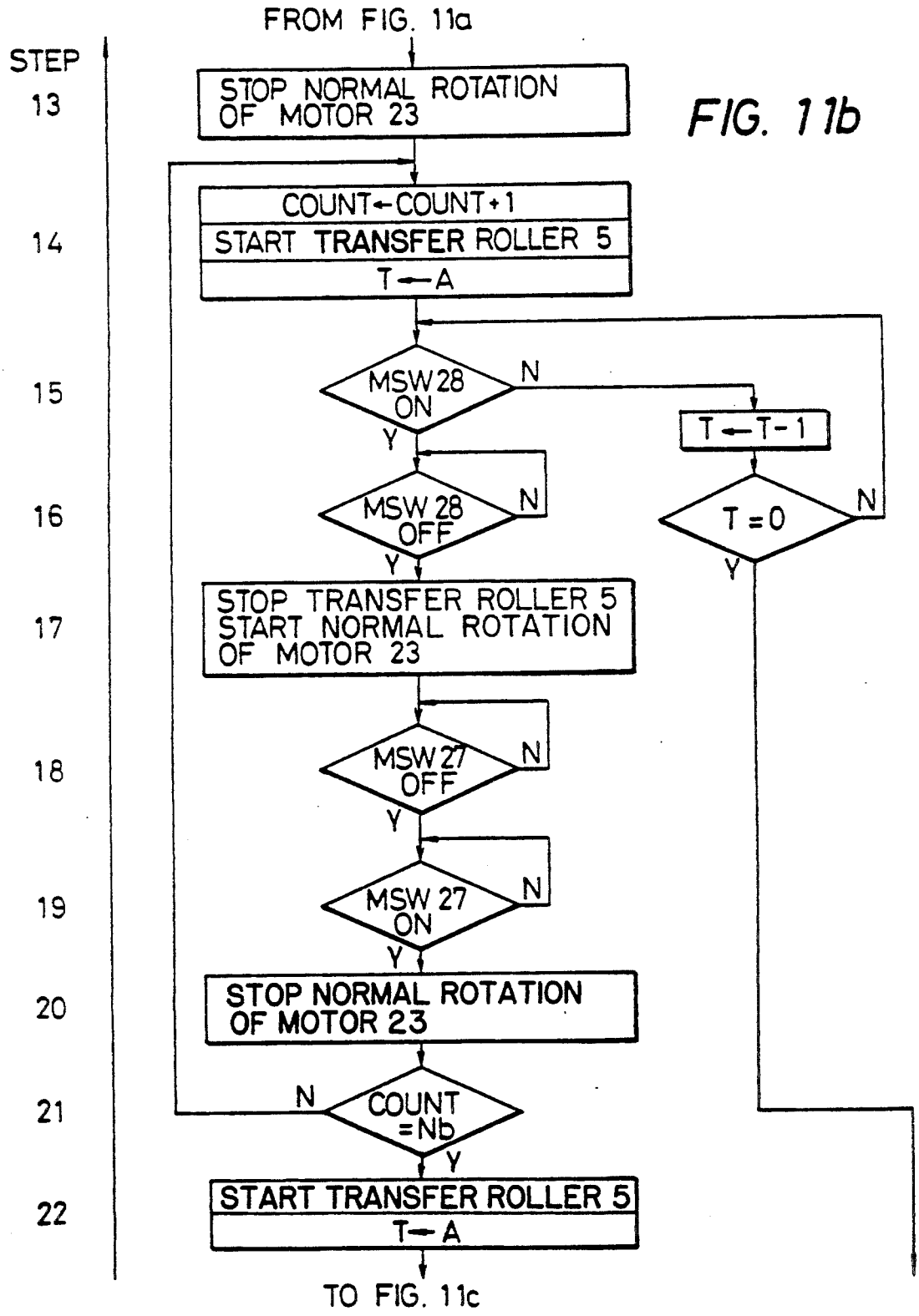
Figure 11C:
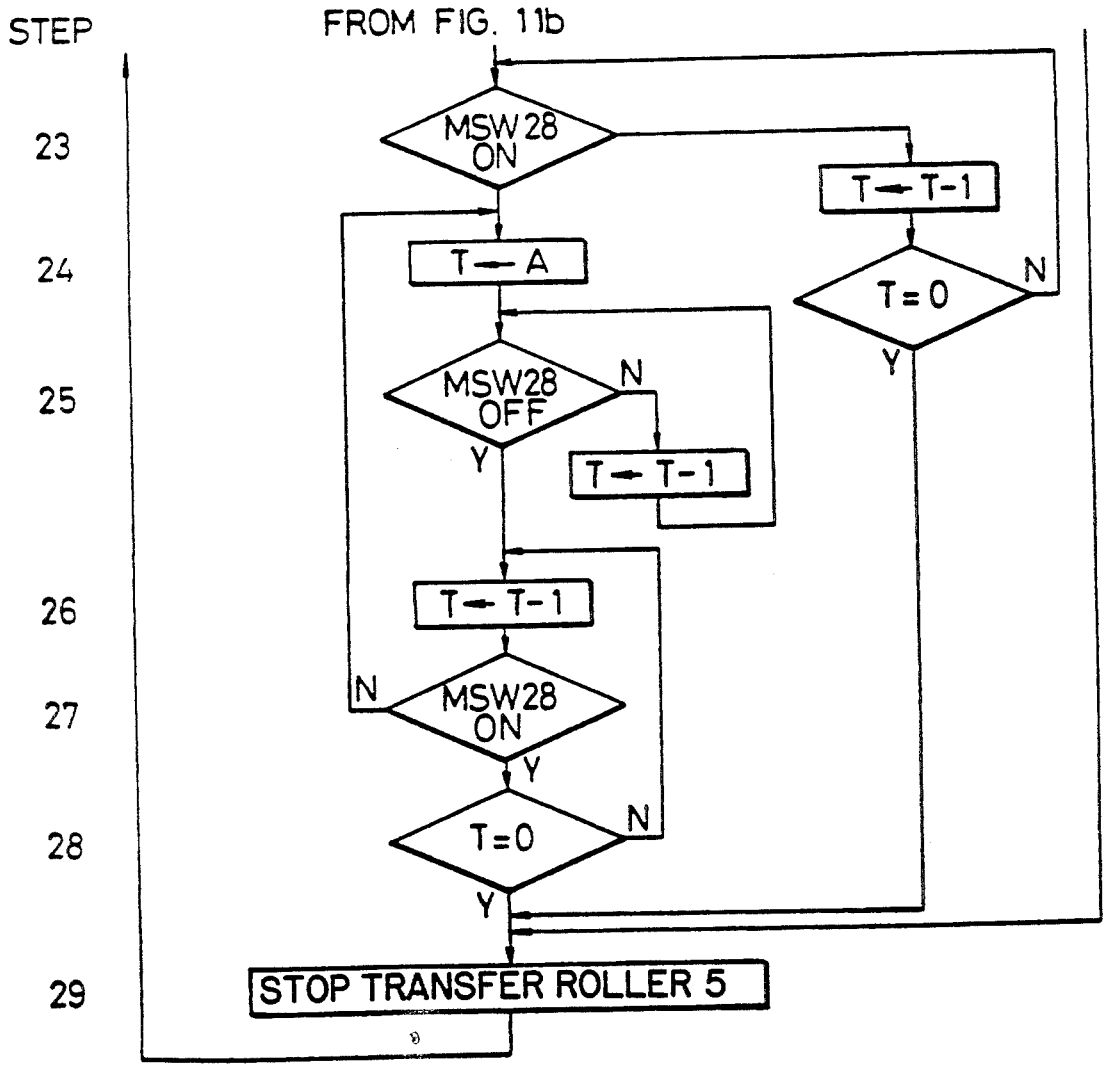

FIG. 11 shows a flow chart briefly showing the control flow of the present embodiment, which will be explained in a simple manner.

Steps 1 to 5

The bin trays are moved to the lowermost end position to enable sheet storage into the uppermost bin tray 106.

Steps 6 to 21

Upon detection of the sheet storage, the spiral cams are rotated to lift the bin tray, with a shift up of the count of the bin indicator. Also an initial value A is set in an automatic returning timer T for achieving automatic return by the automatic reverse rotation of the spiral cams. Therefore, in case a succeeding tray does not receive the sheet within the time A (Steps 14 to 16), the spiral cams perform reverse rotation whereby the program returns to the step 29. As long as the sheets are received in the normal manner, the loop of the steps 14 to 21 is repeated by a number equal to the number of movable bin trays Nb.

Steps 22 to 29

When the sheet is stored in the lowermost bin tray 109, the automatic returning timer T is reset, and the automatic returning is executed if the succeeding sheet is not received within a determined time.

What I claim is:

1. A sheet sorting apparatus comprising:

plural bin trays arranged in vertical alignment, said trays including a front end for receiving said sheets;

followers associated with the front ends of said bin trays;

front end support means for supporting the front ends of said plural bin trays for vertical movement; and a cam member formed with a spiral grove for guiding said bin trays, said groove having an end portion of less inclination relative to a horizontal plane than he inclination of the remainder of said groove.

2. A sheet sorting apparatus according to claim 1, wherein one of sad followers, when lifted-up to the starting position on said less-inclined end portion, contacts another of said followers located adjacently thereabove, and thereafter ascends while pushing up said adjacent follower.

3. A sheet sorting apparatus according to claim 2, wherein said front end support means ascends together with the remaining followers in synchronism during the lifting-up of said followers.

4. A sheet sorting apparatus according to claim 1, wherein said spiral cam means comprises a pick-up portion positioned at substantially the same height as the lowermost portion of the follower which stands by at a starting position, said pick-up portion guiding said follower to the spiral groove upon revolution of said spiral cam means.

5. A sheet sorting apparatus according to claim 1, wherein said spiral cam means comprises upper and lower planar surfaces, and said spiral am means stops at a position where said upper and lower planar surface oppose the followers.

6. A sheet sorting apparatus comprising:

plural bin trays arranged in vertical alignment, said bin trays including a front end for receiving the sheets;

front end support means for supporting the front ends of said plural bin trays for vertical movement;

means for moving the respective front ends of said bin trays to enlarge the opening between successive trays; and resilient means engaged at one end thereof with the uppermost bin tray and engaged at the other end thereof with the lowermost bin tray, and urging said bin trays toward one another, whereby when a respective bin tray is moved to enlarge the opening between successive bin trays, the remaining bin trays are moved in the same direction by said resilient means.

7. A sheet sorting apparatus according to claim 6, further including rear end support means for supporting the rear ends of said plural bin trays.

8. A sheet sorting apparatus according to claim 7, wherein means are provided for moving said rear end support means vertically relative to said front end support means.

9. A sheet sorting apparatus according to claim 8, wherein said respective means for moving sad front ends of said bin trays include a cam member formed with a spiral groove for guiding said bin trays, said groove having an end portion of less inclination relative to a horizontal plane than the inclination of the remainder of said groove.

10. A sheet sorting apparatus, comprising:

plural bin trays arranged in vertical alignment;

front end support frame for supporting the front ends of said plural bin trays, said frame movable by ascending and descending; and plural followers associated with the front ends of said bin trays and movable by ascending and descending in relation to said front end support frame;

a follower provided uppermost with respect to said plural followers and secured to said front end support frame;

rotating means for moving said plural followers of respective said bin rays vertically by engaging therewith to enlarge the opening between successive trays; and stopper means for restraining said front end support means at the lowermost position thereof;

wherein when said front end support frame is located at the lowermost position, said uppermost bin tray is located below said rotating means, and said follower of uppermost bin tray is opposed to an engaging inlet portion of said rotating means.

* * * * *

UNITED STATES PATENT AND TRADEMARK OFFICE

CERTIFICATE OF CORRECTION

PATENT NO. : 5,090,688

DATED : February 25, 1992

INVENTOR(S) : NOBUKAZU SASAKI

It is certified that error appears in the above-identified patent and that said Letters Patent is hereby corrected as shown below:

COLUMN 3

Line 7, "a flow chart" should read --flow charts--.

COLUMN 4

Line 47, "steep" should read --steep or--.

COLUMN 9

Line 65, "grove" should read --groove--.
Line 68, "he" should read --the--.

COLUMN 10

Line 2, "sad" should read --said--.
Line 20, "am" should read --cam--.
Line 48, "sad" should read --said respective--.

Signed and Sealed this

Sixth Day of July, 1993

*Attest:*

Michael K. Kirk

MICHAEL K. KIRK

*Attesting Officer*

*Acting Commissioner of Patents and Trademarks*